US010968672B2

(12) United States Patent
Schmid

(10) Patent No.: US 10,968,672 B2
(45) Date of Patent: Apr. 6, 2021

(54) FURNITURE FITTING

(71) Applicant: Julius Blum GmbH, Hoechst (AT)

(72) Inventor: Malte Schmid, Bodolz (DE)

(73) Assignee: JULIUS BLUM GMBH, Hoechst (AT)

( * ) Notice: Subject to any disclaimer, the term of this patent is extended or adjusted under 35 U.S.C. 154(b) by 110 days.

(21) Appl. No.: 16/204,440

(22) Filed: Nov. 29, 2018

(65) Prior Publication Data

US 2019/0093404 A1 Mar. 28, 2019

Related U.S. Application Data

(63) Continuation of application No. PCT/AT2017/060095, filed on Apr. 13, 2017.

(30) Foreign Application Priority Data

Jun. 22, 2016 (AT) ..... A 50563/2016

(51) Int. Cl.
*E05D 11/06* (2006.01)
*E05F 1/10* (2006.01)
(Continued)

(52) U.S. Cl.
CPC ..... *E05D 11/06* (2013.01); *E05F 1/1058* (2013.01); *E05F 1/1261* (2013.01); *E05F 1/14* (2013.01);
(Continued)

(58) Field of Classification Search
CPC ... E05D 11/06; E05D 3/142; E05D 2003/163; E05F 1/1058; E05F 1/1261; E05F 1/14
(Continued)

(56) References Cited

U.S. PATENT DOCUMENTS 2,638,620 A * 5/1953 Civitelli ..... E05D 11/06 16/375
3,902,220 A * 9/1975 Little ..... E05F 1/1261 16/290
(Continued)

FOREIGN PATENT DOCUMENTS

CN 104314404 1/2015
CN 104968879 10/2015
(Continued)

OTHER PUBLICATIONS

International Search Report dated Aug. 1, 2017 in International (PCT) Application No. PCT/AT2017/060095.
(Continued)

*Primary Examiner* — Jeffrey O'Brien
(74) *Attorney, Agent, or Firm* — Wenderoth, Lind & Ponack, L.L.P.

(57) ABSTRACT

A furniture fitting for moving a furniture part movably supported relative to a furniture carcass includes a first fitting portion to be fixed to a furniture carcass, and a second fitting portion to be fixed to a movable furniture part. The second fitting portion is pivotally connected to the first fitting portion, and a limiting device limits an opening angle of a relative pivoting movement of the first and second fitting portion. The limiting device includes at least one movably mounted actuating element, and the opening angle can be adjusted by a manual or by a tool-assisted actuation of the actuating element.

13 Claims, 6 Drawing Sheets

(51) Int. Cl.
*E05F 1/12* (2006.01)
*E05F 1/14* (2006.01)
*E05D 3/16* (2006.01)

(52) U.S. Cl.
CPC ..... *E05D 2003/163* (2013.01); *E05Y 2600/10* (2013.01); *E05Y 2900/20* (2013.01)

(58) Field of Classification Search
USPC ..... 16/371, 374, 375, 376
See application file for complete search history.

(56) References Cited

U.S. PATENT DOCUMENTS

| | | | | |
|---|---|---|---|---|
| 4,914,782 | A * | 4/1990 | Rupprechter | E05D 3/16 16/319 |
| 5,035,026 | A * | 7/1991 | Carlo | E05D 3/16 16/288 |
| 5,727,289 | A * | 3/1998 | Reder | E05F 5/06 16/375 |
| 6,453,804 | B1 * | 9/2002 | Lee | A23L 3/001 165/206 |
| 8,756,763 | B1 * | 6/2014 | Ham | E05D 3/10 16/239 |
| 8,857,014 | B2 * | 10/2014 | Brunnmayr | E05F 5/02 16/82 |
| 9,498,062 | B2 * | 11/2016 | Baldreich | E05D 11/1064 |
| 9,803,405 | B2 * | 10/2017 | Zetti | E05D 11/06 |
| 10,407,962 | B2 * | 9/2019 | Schluge | F16H 21/44 |
| 10,494,846 | B2 * | 12/2019 | Schmid | E05D 15/40 |
| 2006/0232090 | A1 * | 10/2006 | Duffy | E05D 3/16 296/76 |
| 2013/0145580 | A1 | 6/2013 | Brunnmayr | |
| 2014/0215761 | A1 * | 8/2014 | Zetti | E05D 7/0407 16/288 |
| 2014/0230189 | A1 * | 8/2014 | Oshima | E05D 3/142 16/308 |
| 2015/0351539 | A1 | 12/2015 | Baldreich et al. | |
| 2017/0241176 | A1 * | 8/2017 | Zetti | E05F 1/1261 |
| 2018/0363346 | A1 * | 12/2018 | Holzapfel | E05F 1/1058 |

FOREIGN PATENT DOCUMENTS

| | | |
|---|---|---|
| DE | 32 39 989 | 5/1984 |
| DE | 90 10 872 | 9/1990 |
| DE | 88 17 256 | 12/1995 |
| DE | 20 2004 010 842 | 11/2004 |
| DE | 10 2010 017 121 | 12/2011 |
| DE | 10 2010 045 187 | 1/2012 |
| DE | 20 2010 014 948 | 3/2012 |
| DE | 20 2011 109 550 | 5/2013 |
| EP | 2 607 590 | 6/2013 |
| GB | 1066710 | 4/1967 |
| JP | 59-10304 | 3/1984 |
| JP | 60-87982 | 6/1985 |
| JP | 1-105178 | 7/1989 |
| JP | 2005-240465 | 9/2005 |
| WO | 2008/024469 | 2/2008 |
| WO | 2011/069179 | 6/2011 |

OTHER PUBLICATIONS

Search Report dated Jan. 16, 2017 in Austrian Application No. A 50563/2016, with English translation.

Chinese Search Report dated Nov. 19, 2019 in corresponding Chinese Patent Application No. 201780038650.7.

* cited by examiner

FURNITURE FITTING

BACKGROUND OF THE INVENTION

The present invention relates to a furniture fitting for moving a furniture part movably supported relative to a furniture carcass, comprising:

- a first fitting portion to be fixed to a furniture carcass,
- a second fitting portion to be fixed to a movable furniture part, wherein the second fitting portion is pivotally connected to the first fitting portion,
- a limiting device for limiting an opening angle of a relative pivoting movement of the first and second fitting portion.

The invention further concerns an item of furniture comprising a furniture carcass, a furniture part movably supported relative to the furniture carcass and such a furniture fitting for moving the movable furniture part.

By a limiting device for limiting a maximum opening angle of the furniture fitting, collisions of the movable furniture part with laterally adjacent cabinets or with a room ceiling can be prevented. Furniture fittings with such limiting devices are, for example, known from WO 2011/069179 A1 and DE 20 2004 010 842 U1, in which stops in the form of clamps can be snapped onto a hinge axis member of the furniture fitting. Upon a pivoting movement of the furniture fitting, a movably mounted portion of the furniture fitting abuts against that clamp, so that the maximum pivoting path of the furniture fitting is limited. A disadvantage is the fact that each of the clamps only limit a predefined pivoting angle and, as a result, clamps of different sizes are required for obtaining different opening angles. There is also the danger that the clamps become detached from the hinge axis member and get lost, whereby the desired limiting of the opening angle of the furniture fitting can no longer be ensured.

SUMMARY OF THE INVENTION

It is an object of the present invention to propose a furniture fitting of the type mentioned in the introductory part, while avoiding the drawbacks discussed above.

According to the invention, the limiting device includes at least one movably mounted actuating element, wherein the opening angle can be adjusted by a manual or by a tool-assisted actuation of the actuating element.

Accordingly, the furniture fitting includes a movably mounted actuating element for adjustably limiting the maximum pivoting path of the furniture fitting. The actuating element is movably arranged on the furniture fitting and captively secured, and, in a mounted condition of the furniture fitting, is freely accessible for the manual or for the tool-assisted actuation. The actuating element can thereby be arranged on the first fitting portion, on the second fitting portion or also on a movably mounted component of the furniture fitting.

The opening angle can be continuously adjusted within predetermined limits by an actuation of the actuating element. Alternatively, it is possible to set the opening angle on a plurality of predetermined locking positions by an actuation of the actuating element.

According to an embodiment, the limiting device can include an abutment portion for limiting the opening angle, and by an actuation of the actuating element, a position of the abutment portion can be adjusted. It can thereby be provided that the abutment portion is operative between at least two components of the furniture fitting which move relative to one another upon a relative pivoting movement of the first and second fitting portion.

The item of furniture according to the invention includes a furniture carcass, a furniture part movably supported relative to the furniture carcass, and a furniture fitting of the described type.

BRIEF DESCRIPTION OF THE DRAWINGS

Further details and advantages of the present invention result from the embodiments shown in the drawings, in which.

DETAILED DESCRIPTION OF THE INVENTION

Figure 1A:
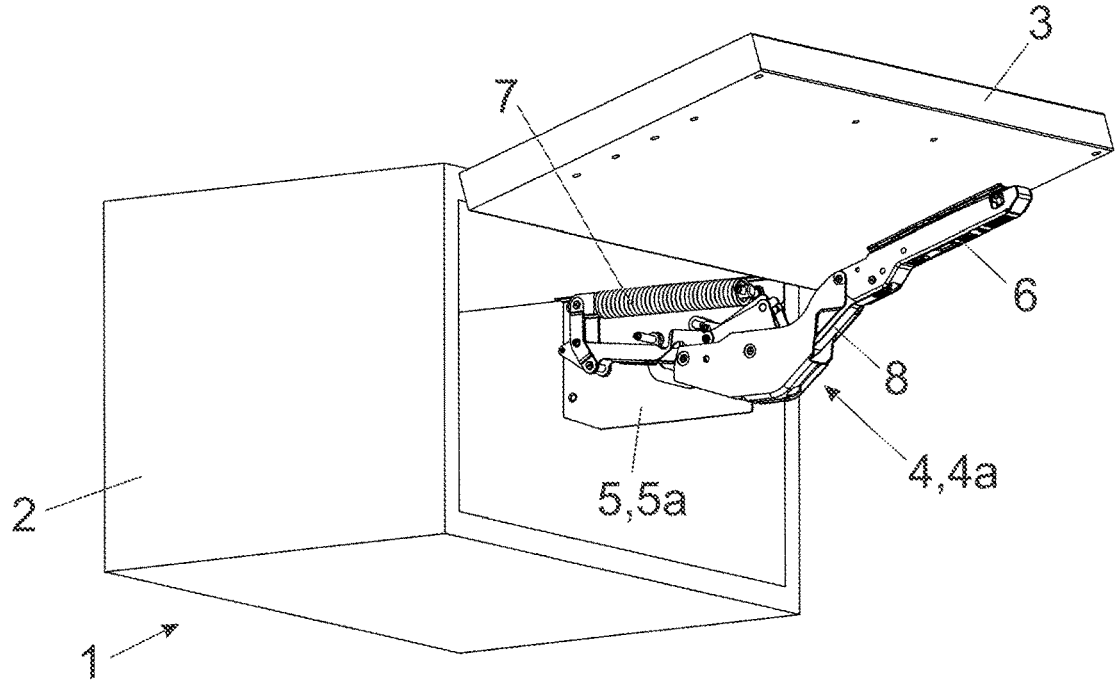
FIG. 1*a*, 1*b* show an item of furniture with a furniture part movably supported relative to a furniture carcass, and a furniture fitting for moving the movable furniture part.

FIG. 1*a* shows a perspective view of an item of furniture 1, in which a movable furniture part 3 is pivotally mounted about a horizontally extending pivoting axis relative to a furniture carcass 2 by a furniture fitting 4. In the shown embodiment, the furniture fitting 4 is configured as an actuating drive 4*a* for a movable furniture part 3 in the form of a furniture flap, so that the movable furniture part 3 can be moved from a vertical closed position into an elevated position relative to the furniture carcass 2 (and in the opposite direction). However, the furniture fitting 4 can also be used for furniture parts 3 which, in a mounted position, are pivotally mounted about a vertically extending pivoting axis relative to the furniture carcass 2. The furniture fitting 4 includes a first fitting portion 5 in the form of a housing 5*a* configured to be fixed to the furniture carcass 2. A second fitting portion 6 of the furniture fitting 4 is configured to be fixed to the movable furniture part 3, and the second fitting portion 6 is pivotally connected to the first fitting portion 5. The first fitting portion 5 and the second fitting portion 6 are connected to one another by at least one first lever 8, and a spring device 7 of the furniture fitting 4 is provided for applying a force to the second fitting portion 6.

Figure 1B:
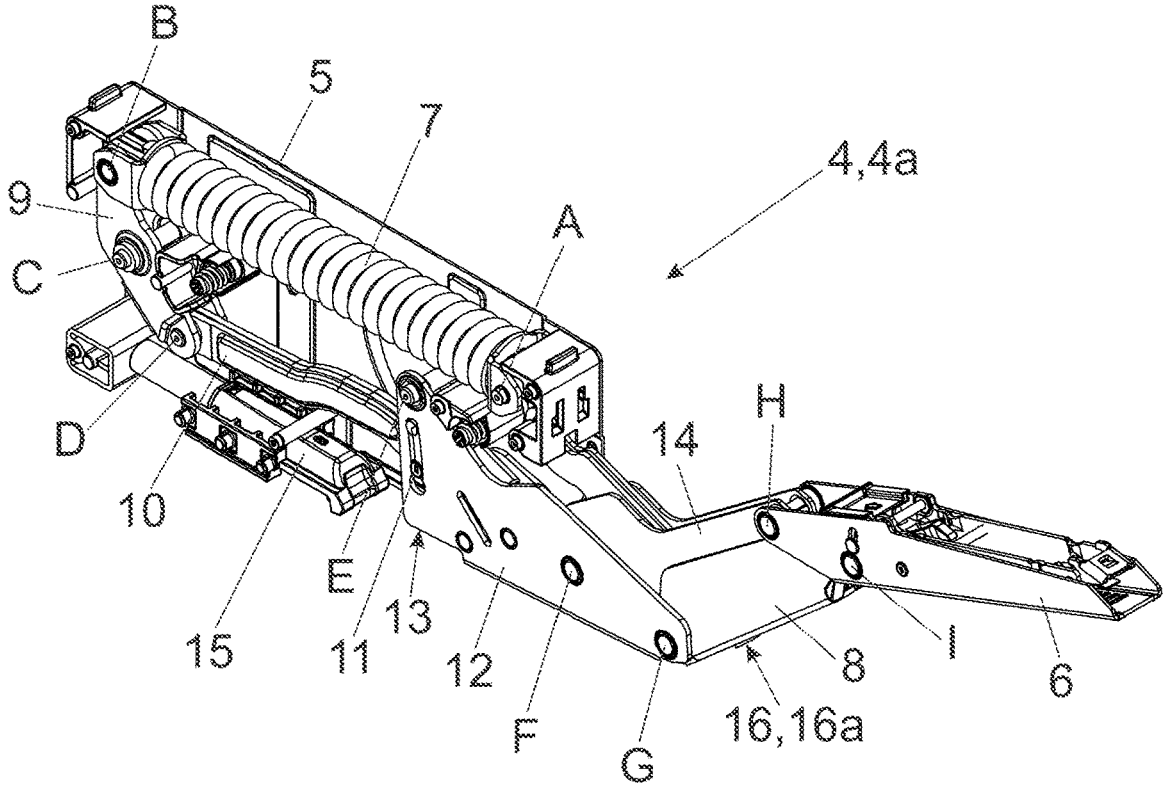

FIG. 1*b* shows the furniture fitting 4 according to a possible embodiment. Arranged on the first fitting portion 5 is the spring device 7 (for example at least one helical spring configured as a compression spring), the spring device 7 being supported on a stationary hinge axis member A and pushes against the hinge axis member B. The hinge axis member B is arranged on a first lever end of a two-armed deflection lever 9 which is pivotally mounted about the hinge axis member C. The second lever end of the deflection lever 9 is connected via the hinge axis member D to a thrust lever 10, the thrust lever 10 being hingedly connected by a pin 11 to a lever 12 which is pivotally mounted about the pivoting axis member E. By an adjustment device 13, the distance of the pin 11 can be variably adjusted relative to the hinge axis member E along a guide of the lever 12, and, as a result, the operative lever arm between the pin 11 and the hinge axis member E and thus the torque acting on the second fitting portion 6 can be variably adjusted. The lever 12 is hingedly connected by the hinge axis members F and G to the first lever 8 and to a second lever 14, and the first lever 8 and the second lever 14 are hingedly connected to the second fitting portion 6 by the hinge axis members H and I. The furniture fitting 4 further includes a damping device 15 in the form if a hydraulic fluid damper which, in the shown embodiment, is configured as a piston-cylinder-unit. Upon a closing movement of the furniture fitting 4, the lever 12 pivotally mounted about the hinge axis member E abuts against a ram of the piston-cylinder-unit, whereupon, for performing a damping hub, a relative movement between the cylinder and the piston of the damping device 15 is brought about and the movement of the lever 12 (and therewith the movement of movable furniture part 3) is decelerated at the end of the closing movement until reaching the fully closed position.

The furniture fitting 4 includes a limiting device 16 for limiting an opening angle of a relative pivoting movement of the first fitting portion 5 and the second fitting portion 6, so that the maximum pivoting path of the second fitting portion 6 (and therewith the maximum pivoting path of the movable furniture part 3) can be limited. For this purpose, a movably mounted actuating element 16*a* is provided, and by a manual or by a tool-assisted actuation of the actuating element 16*a*, the maximum opening angle of the furniture fitting 4 can be adjustably limited. The limiting device 16 is of advantage, for example, when the movable furniture part 3, in a mounted position, is located immediately below a room ceiling and a collision between the movable furniture part 3 and the room ceiling shall be prevented upon opening. Likewise, the limiting device 16 is also useful in connection with furniture parts 3 which, in a mounted position, are pivotally mounted about a vertically extending pivoting axis, so that upon an opening movement of the furniture part 3, a collision with objects located laterally besides the furniture carcass 2 can be prevented. The actuating element 16*a* of the limiting device 16 is arranged on the first lever 8. In the shown embodiment, the levers 8 and 14, together with the hinge axis members F, G, H, I, jointly form a four-bar linkage, and the distance between the levers 8, 14 can be limited by the limiting device 16.

Figure 2A:
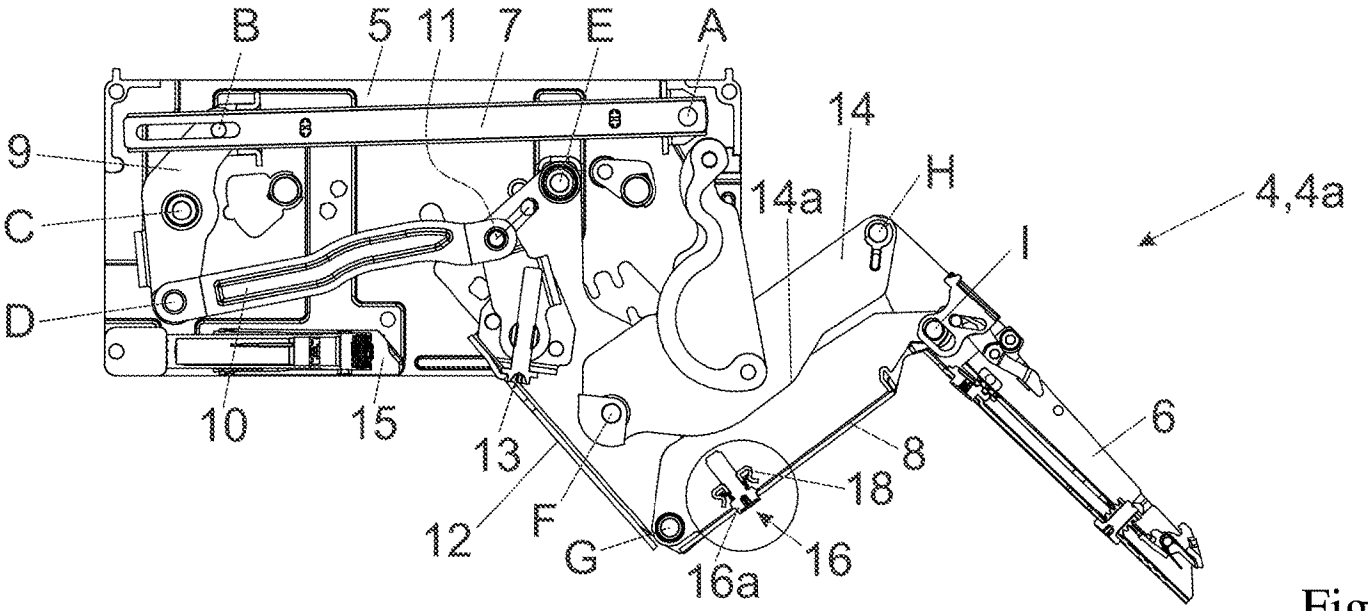
FIG. 2*a*-2*d* are cross sectional views of the furniture fitting and different positions of an abutment portion configured to be adjusted by a limiting device for limiting a maximum opening angle of the furniture fitting.

FIG. 2*a* shows a cross sectional view of the furniture fitting 4 configured as an actuating drive 4*a*. Here, the adjustment device 13 having an adjustment wheel is visible in greater detail. By rotating the adjustment wheel, the distance of the pin 11 relative to the hinge axis member E can be adjusted along a guide of the lever 12 and, as a result, the torque from the spring device 7 acting of the second fitting portion 6 can be adjusted. Moreover, the limiting device 16 with an actuating element 16*a* is visible, the actuating element 16*a* being provided for limiting an opening angle of a relative pivoting movement between the first fitting portion 5 and the second fitting portion 6. In the shown embodiment, the actuating element 16*a* is movably mounted—preferably pivotally—on the first lever 8, and by rotating the actuating element 16*a*, an abutment portion 18 configured to be supported on the second lever 14 can be adjusted for limiting the opening angle. The levers 8 and 14, in a cross sectional view, each have a U-shaped profiled portion with two limbs 14*a* extending parallel to one another, and the abutment portion 18 can be supported on at least one of the limbs 14*a* of the second lever 14, preferably on a material thickness of the limb 14*a*.

Figure 2B:
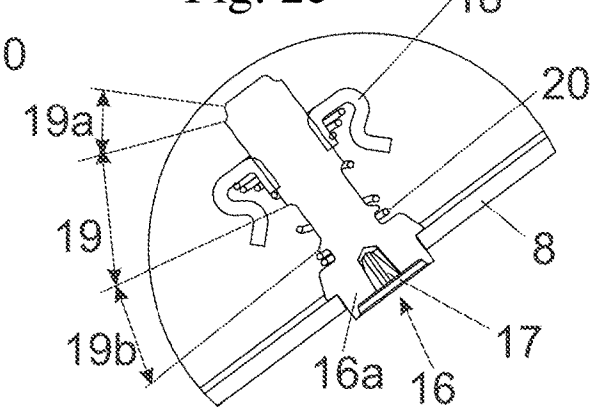
Figure 2C:
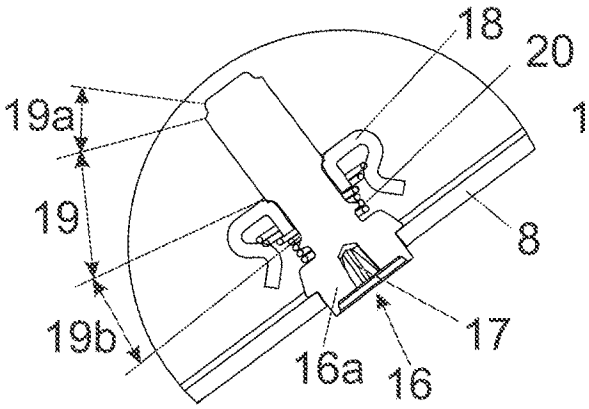
Figure 2D:
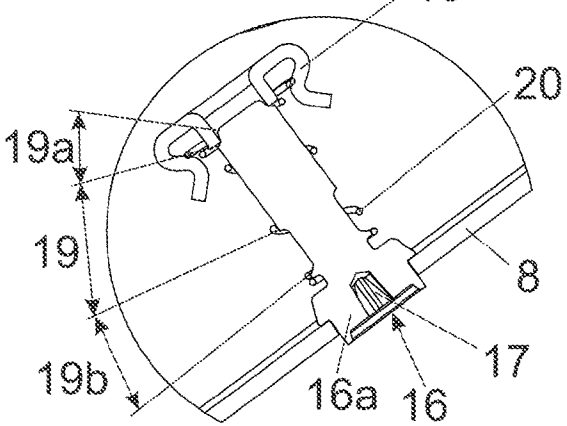

FIG. 2*b*-2*d* each show the encircled region of FIG. 2*a* in an enlarged view, in which different positions of the abutment portion 18 are depicted. The actuating element 16*a* includes a receiving device 17 for a tool, and by rotating the receiving device 17 with the aid of the tool, the abutment portion 18 in the form of a threaded nut can be adjusted along a threaded portion 19. It is preferably provided that the threaded portion 19, together with the actuating element 16*a*, has a one-piece configuration. A first threadless portion 19*a* and a second threadless portion 19*b* adjoin the threaded portion 19, and the first threadless portion 19*a* and the second threadless portion 19*b* are spaced from each other in a longitudinal direction of the threaded portion 19.

The abutment portion 18 in the form of the threaded nut is pre-stressed by a spring element 20 in the form of a helical spring, and a first end region of the helical spring is fixed to actuating element 16*a* and a second end region of the helical spring is fixed to the abutment portion 18. The abutment portion 18, when entering the first threadless portion 19*a*, can be pressurized with a force acting in a direction towards the second threadless portion 19*b*, and, when entering the second threadless portion 19*b*, can be pressurized with a force acting in a direction towards the first threadless portion 19*a*. Accordingly, the spring element 20, on the one hand, serves for the purpose to prevent jamming between the abutment portion 18 and the actuating element 16*a* (clamping protection), and, on the other hand, to prevent the abutment portion 18 from getting lost from the first threadless portion 19*a* (release protection). Furthermore, the spring element 20 serves for prestressing the abutment portion 18, when the latter is located on one of the threadless portions 19*a*, 19*b*, in a direction towards the threaded portion 19, so that the engagement of the abutment portion 18 with the threaded portion 19 can be facilitated.

In FIG. 2*b*, the abutment portion 18 in the form of the threaded nut is located on the second threadless portion 19*b*, so that the abutment portion 18 is released from the threading engagement. The abutment portion 18 is thus located in an idle position and cannot be jammed with the actuating element 16*a* upon rotating the latter. The spring element 20 in FIG. 2*b* acts as a compression spring, so that the abutment portion 18 is pushed away from the actuating element 16*a* in a direction towards the threaded portion 19, so that the abutment portion 18, when rotating the actuating element 16*a* in the opposite direction, can be immediately engaged with the threaded portion 19.

FIG. 2*c* shows the abutment portion 18 configured as a threaded nut being in engagement with the threaded portion 19. By a continued rotational movement of the actuating element 16*a*, the abutment portion 18 can eventually be moved into the position shown in FIG. 2*d*, in which the abutment portion 18 is located on the first threadless portion 19*a* and hence the threading engagement of the abutment portion 18 is also released. Because the spring element 20, on the one hand, is fixedly attached to the actuating element 16*a*, and, on the other hand, to the abutment portion 18, the spring element 20 in FIG. 2*d* is in a tensioned condition and pulls the abutment portion 18 in a direction towards the threaded portion 19. In this way, the abutment portion 18 is captively secured to the actuating element 16*a*, and, upon a respective rotational movement of the actuating element 16*a*, the abutment portion 18 can be immediately engaged with the threaded portion 19.

Figure 3A:
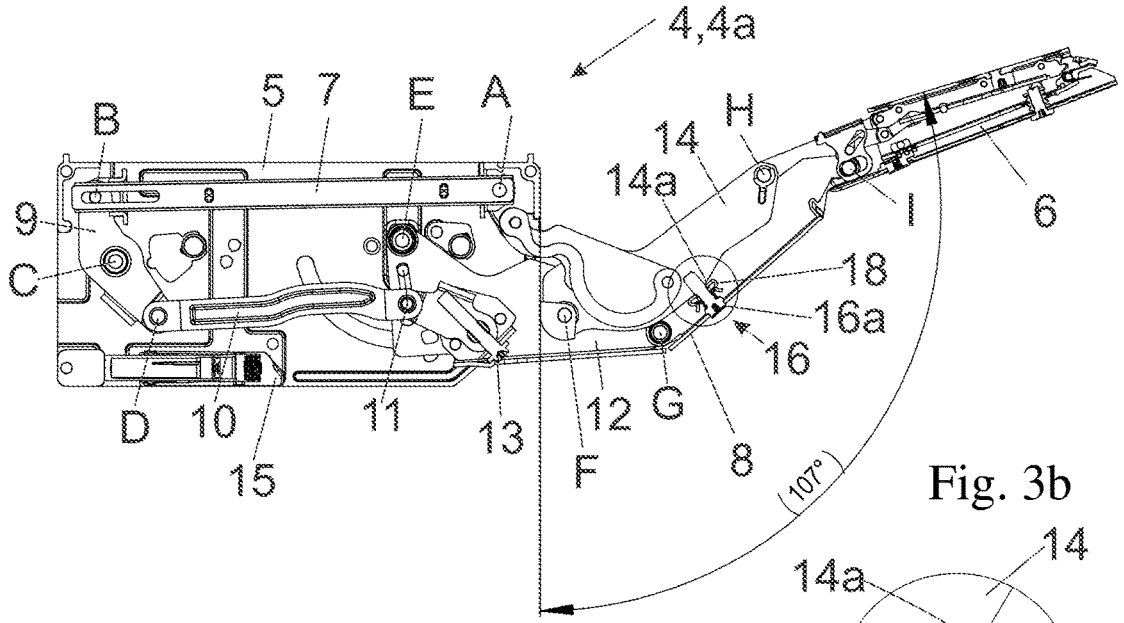
FIG. 3*a*-3*d* show the furniture fitting with two different maximum opening angles and enlarged detail views thereof.
Figure 3B:
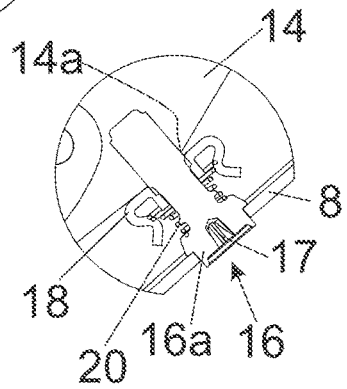

FIG. 3*a* shows the furniture fitting 4 configured as an actuating drive 4*a*, in which the limiting device 16 limits the opening angle of the second fitting portion 6 relative to the first fitting portion 5, for example to an extent of 107°. The abutment portion 18 configured to be adjusted by the actuating element 16*a* thereby rests against the limb 14*a* of the second lever 14 and thereby prevents a further opening movement of the second fitting portion 6. FIG. 3*b* shows the region encircled in FIG. 3*a* in an enlarged view.

Figure 3C:
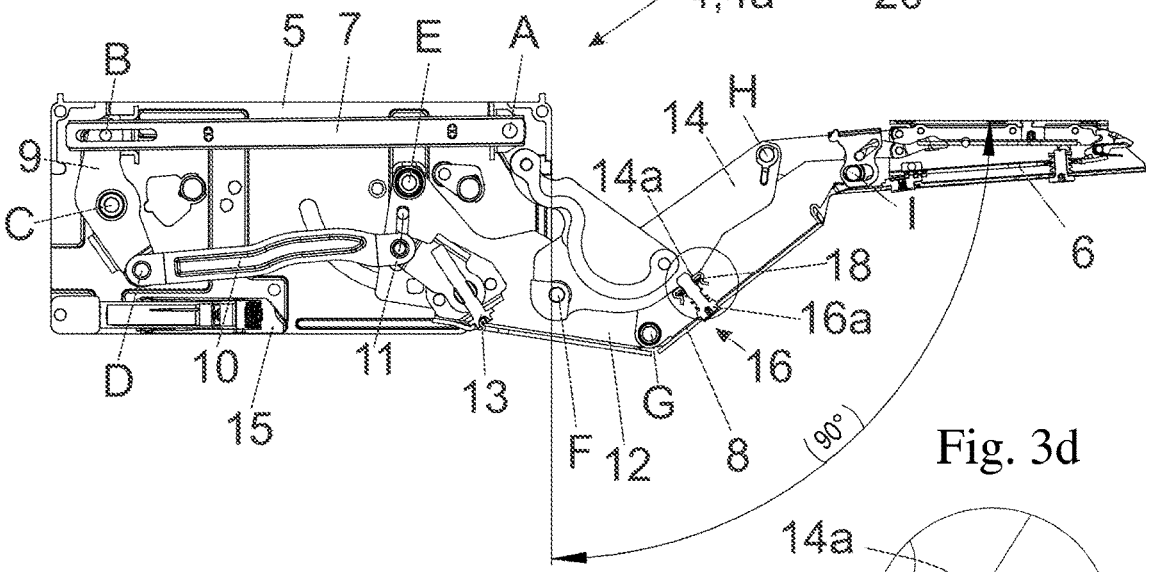
Figure 3D:
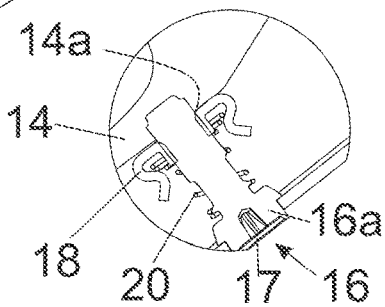

FIG. 3*c* shows the furniture fitting 4 in which the opening angle of the second fitting portion 6 relative to the first fitting portion 5 is limited by the limiting device 16 to an exemplary extent of 90°. FIG. 3*d* shows the region encircled in FIG. 3*c* in an enlarged view, in which the different positions of the abutment portion 18 (see FIGS. 3*b* and 3*d*) relative to the threaded portion 19 (see FIGS. 2*a*-2*d*) can be recognized. The abutment portion 18 thereby rests against a material thickness of a limb 14*a* of the second lever 14 and thereby prevents a further opening movement of the second fitting portion 6 relative to the first fitting portion 5.

Figure 4A:
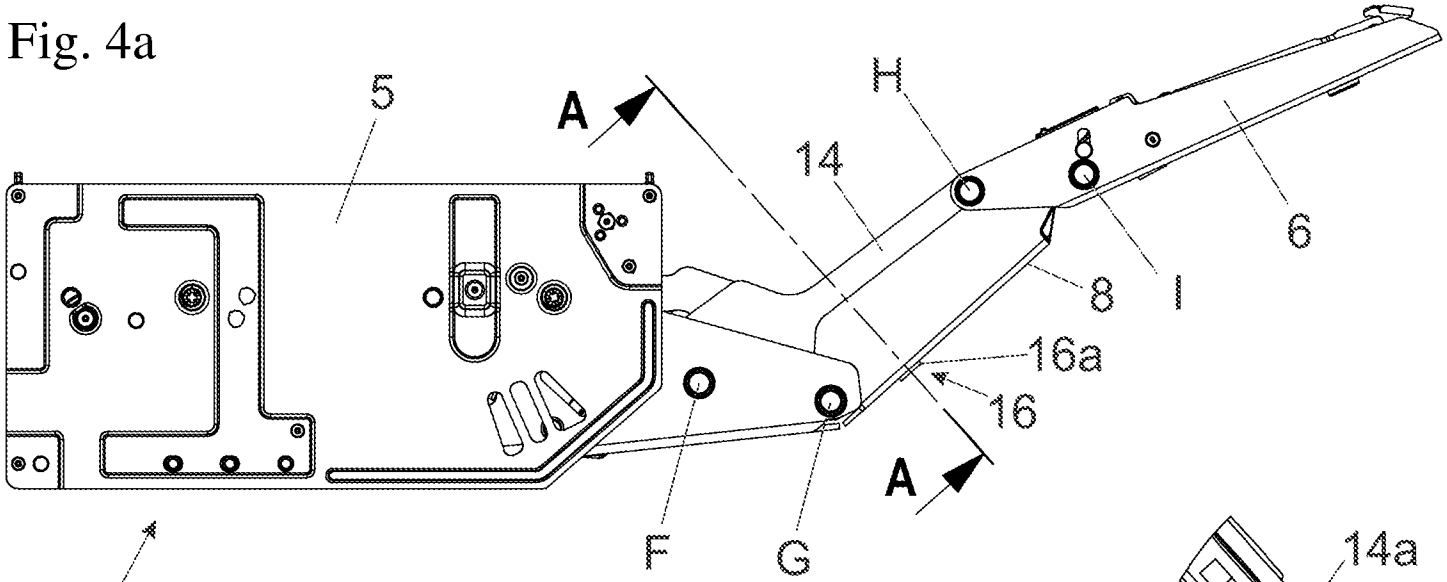
FIG. 4*a*-4*c* show the furniture fitting in a side view and enlarged detail views thereof.
Figure 4C:
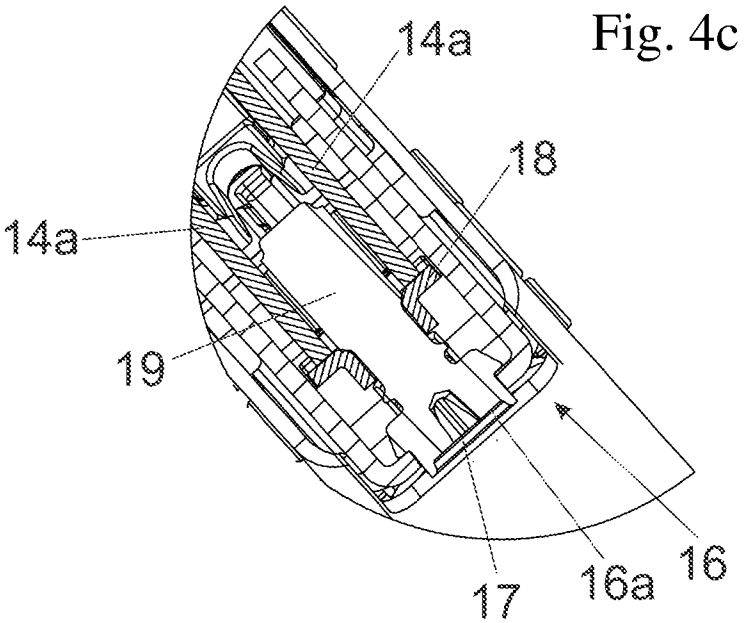
Figure 4B:
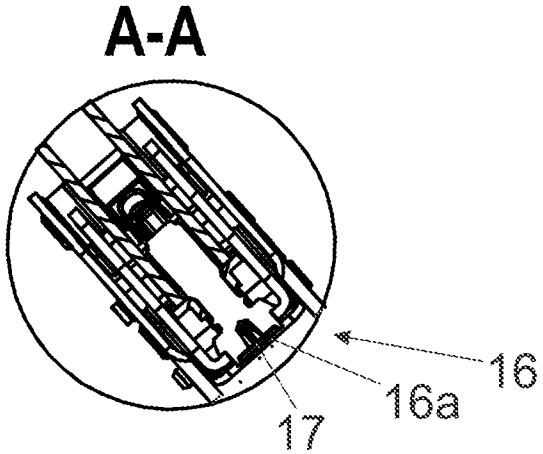

FIG. 4*a* shows a side view of the furniture fitting 4, in which the limiting device 16 for limiting a maximum opening angle of the furniture fitting 4 is operative between the levers 8 and 14. FIG. 4*b* shows a cross sectional view along the plane A-A depicted in FIG. 4*a*. FIG. 4*c* shows an enlarged view of the region encircled in FIG. 4*b*. In FIG. 4*c*, the pivotally mounted actuating element 16*a* is visible, and by rotating the actuating element 16*a*, the abutment portion 18 can be moved along the threaded portion 19. The second lever 14, in a cross sectional view, has a U-shaped profiled portion having two limbs 14*a* extending parallel to one another, and the abutment portion 18, in a position in which the opening angle is limited, rests against at least one of the two limbs 14*a* of the second lever 14. This offers the opportunity to nest the first lever 8 and the second lever 14 into one another, whereby a compact construction of the levers 8, 14 together with the limiting device 16 integrated therein can be brought about.

Figure 5A:
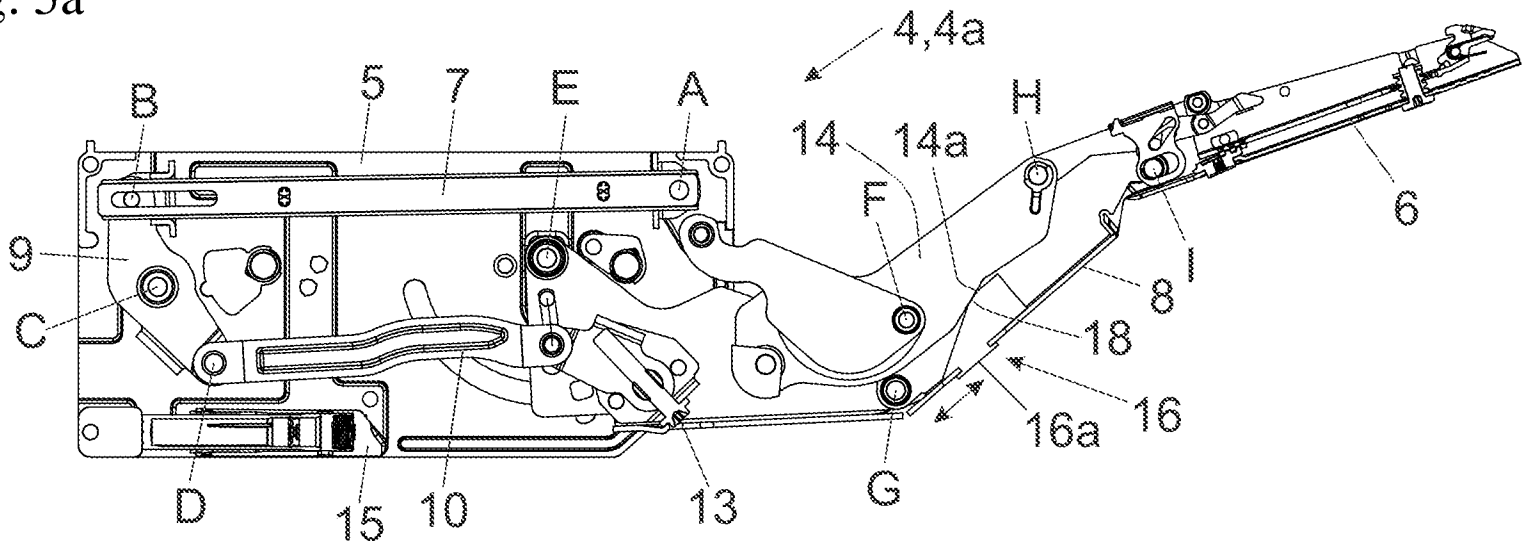
FIG. 5*a*, 5*b* show the furniture fitting with an actuating element in the form of a displaceable slider in two different positions.

FIG. 5*a* shows the furniture fitting 4 configured as an actuating drive 4*a* with a limiting device 16 which, for limiting a maximum opening angle, includes a displaceably mounted actuating element 16*a*. The actuating element 16*a* is displaceably arranged on the first lever 8 of the furniture fitting 4 in the directions of the depicted double arrow, and, in the shown figure, the actuating element 16*a*, together with the abutment portion 18, has a one-piece configuration. In FIG. 5*a*, the maximum opening angle is again limited to an extent of 107°, and the abutment portion 18 of the actuating element 16*a* rests against the limb 14*a* of the second lever 14.

Figure 5B:
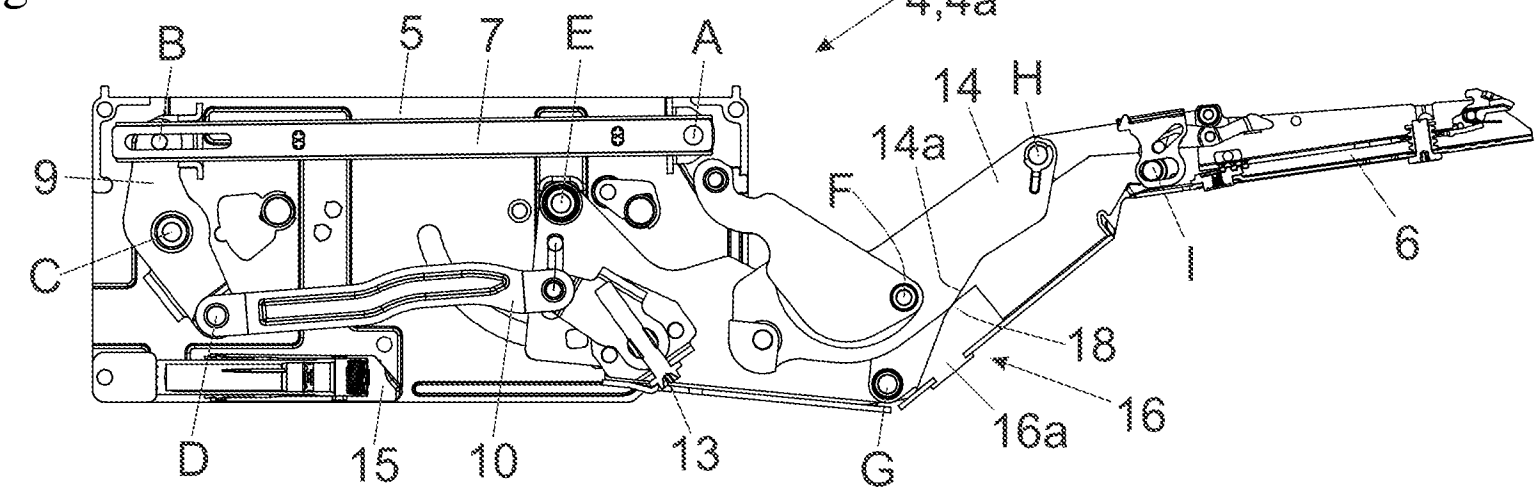

FIG. 5*b* shows the furniture fitting 4 according to FIG. 5*a* with an actuating element 16*a* which, by a manual or by a tool-assisted actuation, has been displaced in a direction towards the hinge axis member G. The maximum opening angle of the furniture fitting 4 is then limited to approximately 90°, and the abutment portion 18 again rests against at least one limb 14*a* of the second lever 14 and thus prevents a continued opening movement of the second fitting portion 6. In order to prevent an undesired displacement of the displaceably mounted actuating element 16*a*, of course a sufficient self-locking has to be provided (for example by locking portions arranged on the actuating element 16*a* cooperating with counter locking portions of the first lever 8).

Figure 6A:
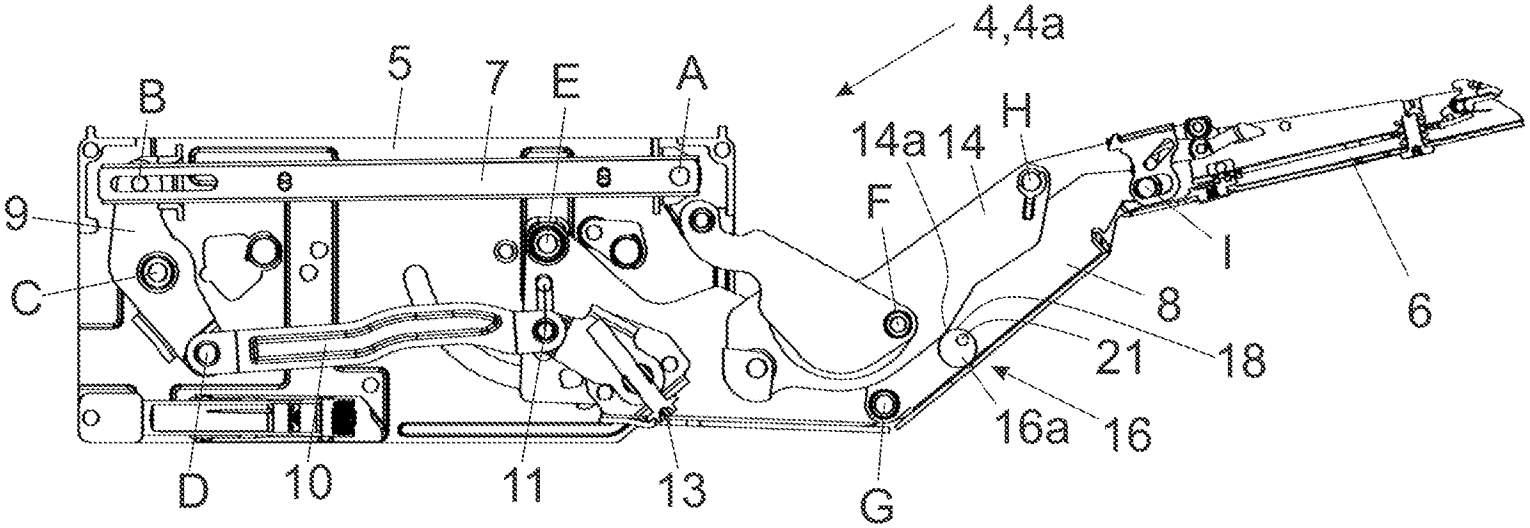
FIG. 6*a*, 6*b* show the furniture fitting with an actuating element in the form of a pivotally mounted eccentric in two different positions.
Figure 6B:
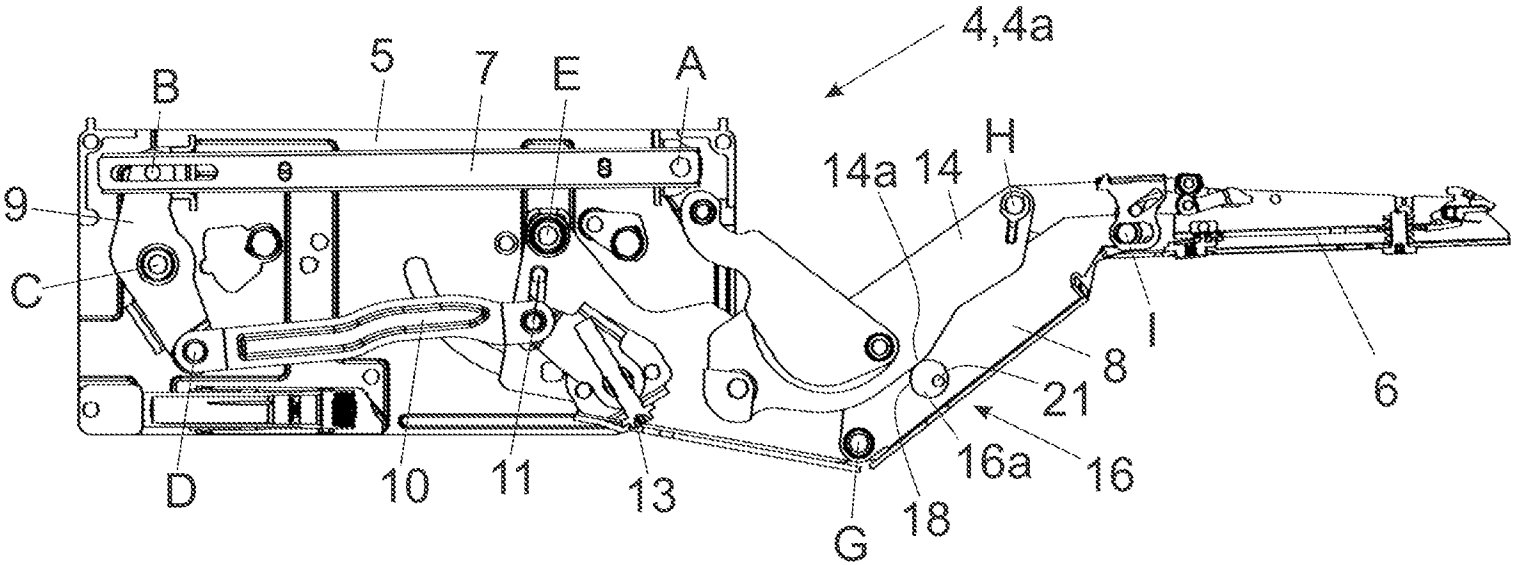

FIG. 6*a* shows the furniture fitting 4 configured as an actuating drive 4*a* with a limiting device 16 which, for limiting a maximum opening angle, includes an actuating element 16*a* in the form of an eccentric pivotally mounted about a pivoting axis 21. The actuating element 16*a* in the form of the eccentric is pivotally mounted on the first lever 8 of the furniture fitting 4 about the pivoting axis 21 extending in parallel relationship with respect to the hinge axis members A, B, C, D, E, F, G, H, I of the furniture fitting 4. The abutment portion 18, together with the actuating element 16*a*, has a one-piece configuration, and the abutment portion 18, for limiting a maximum opening angle, can be supported on at least one of the limbs 14*a* of the second lever 14. In FIG. 6*a*, the opening angle of the second fitting portion 6 is limited to an extent of approximately 109°, and by rotating the eccentric about the pivoting axis 21, the opening angle can be limited to an extent of approximately 90° (see FIG. 6*b*).

Although the invention has been shown and explained with aid of a furniture fitting 4 in the form of an actuating device 4*a* for furniture flaps, it is also well understandable that the shown embodiments of the limiting device 16 can also be utilized in combination with a furniture hinge (with a hinge arm and with a hinge cup configured as fitting portions).

The invention claimed is:

1. A furniture fitting for moving a furniture part movably supported relative to a furniture carcass, comprising:

a first fitting portion configured to be fixed to the furniture carcass;

a second fitting portion configured to be fixed to the movable furniture part, wherein the second fitting portion is pivotally connected to the first fitting portion;

a limiting device for limiting an opening angle of a relative pivoting movement of the first and second fitting portion; and a first lever and a second lever, wherein the first fitting portion and the second fitting portion are pivotally connected to one another by the first and second levers, wherein the limiting device includes an abutment configured to be supported on the second lever so as to limit the opening angle, and an actuating element movably mounted on the first lever, the actuating element being coupled to the abutment and configured to adjust a position of the abutment by a manual or tool-assisted actuation of the actuating element to thereby adjust the opening angle, wherein the second lever includes a U-shaped profiled portion when viewed along a length direction of the second lever, the U-shaped profiled portion having two limbs, and the abutment is configured to be supported on at least one of the limbs of the U-shaped profiled portion, and wherein the abutment is configured to be supported on a narrowest side of the at least one of the limbs, wherein the narrowest side defines a thickness of a material which forms the second lever.

2. The furniture fitting according to claim 1, wherein the opening angle is configured to be continuously adjusted within predetermined limits by an actuation of the actuating element.

3. The furniture fitting according to claim 1, wherein the actuating element is pivotally mounted on the first lever.

4. The furniture fitting according to claim 1, wherein the furniture fitting includes a spring arranged to apply a force to the second fitting portion.

5. The furniture fitting according to claim 1, wherein the actuating element, in a mounted condition of the furniture fitting, is freely accessible for the manual or tool-assisted actuation.

6. The furniture fitting according to claim 1, wherein the actuating element is captively secured to the furniture fitting.

7. The furniture fitting according to claim 1, wherein the furniture fitting is configured as an actuating drive for furniture flaps.

8. An item of furniture comprising:

a furniture carcass;

a furniture part movably supported relative to the furniture carcass; and the furniture fitting according to claim 1 for moving the movable furniture part.

9. The furniture fitting according to claim 3, wherein the actuating element has a receiving device for a tool, and the opening angle is configured to be adjusted by rotating the receiving device with the aid of the tool.

10. The furniture fitting according to claim 1, wherein the limbs of the U-shaped profiled portion are parallel to one another.

11. A furniture fitting for moving a furniture part movably supported relative to a furniture carcass, comprising:

a first fitting portion configured to be fixed to the furniture carcass;

a second fitting portion configured to be fixed to the movable furniture part, wherein the second fitting portion is pivotally connected to the first fitting portion;

a limiting device for limiting an opening angle of a relative pivoting movement of the first and second fitting portion; and a first lever and a second lever, wherein the first fitting portion and the second fitting portion are pivotally connected to one another by the first and second levers, wherein the limiting device includes an abutment configured to be supported on the second lever so as to limit the opening angle, and an actuating element movably mounted on the first lever, the actuating element being coupled to the abutment and configured to adjust a position of the abutment by a manual or tool-assisted actuation of the actuating element to thereby adjust the opening angle, wherein the second lever includes a U-shaped profiled portion when viewed along a length direction of the second lever, the U-shaped profiled portion having two limbs, and the abutment is configured to be supported on at least one of the limbs of the U-shaped profiled portion, wherein the abutment is configured as a threaded nut configured to be moved along a threaded portion of the actuating element by rotating the actuating element, wherein a first threadless portion and a second threadless portion adjoin the threaded portion, and the first threadless portion and the second threadless portion are spaced from each other in a longitudinal direction of the threaded portion, wherein the abutment is pre-stressed by a spring element, wherein the spring element is configured as a helical spring having a first end region and a second end region, and wherein the first end region of the helical spring is fixed to the actuating element and the second end region of the helical spring is fixed to the abutment, so that the abutment is configured to, when entering the first threadless portion, be pressurized with a force acting in a direction towards the second threadless portion, and is configured to, when entering the second threadless portion, be pressurized with a force acting in a direction towards the first threadless portion.

12. The furniture fitting according to claim 11, wherein the threaded portion, together with the actuating element, has a one-piece configuration.

13. A furniture fitting for moving a furniture part movably supported relative to a furniture carcass, comprising:

a first fitting portion configured to be fixed to the furniture carcass;

a second fitting portion configured to be fixed to the movable furniture part, wherein the second fitting portion is pivotally connected to the first fitting portion;

a limiting device for limiting an opening angle of a relative pivoting movement of the first and second fitting portion; and a first lever and a second lever, wherein the first fitting portion and the second fitting portion are pivotally connected to one another by the first and second levers, wherein the limiting device includes an abutment configured to be supported on the second lever so as to limit the opening angle, and an actuating element movably mounted on the first lever, the actuating element being coupled to the abutment and configured to adjust a position of the abutment by a manual or tool-assisted actuation of the actuating element to thereby adjust the opening angle, wherein the second lever includes a U-shaped profiled portion when viewed along a length direction of the second lever, the U-shaped profiled portion having two limbs, and the abutment is configured to be supported on at least one of the limbs of the U-shaped profiled portion, wherein the abutment is configured to be supported on a narrowest side of the at least one of the limbs, wherein the narrowest side defines a thickness of a material which forms the second lever; and wherein the furniture fitting includes at least seven hinge axes.

* * * * *